United States Patent [19]

Erf

[11] 4,413,050

[45] Nov. 1, 1983

[54] PHOTOGRAPHIC PROCESS OF PRODUCING PHOTOGRAPHIC PRINTS UPON INSTANT PRINT FILM

[76] Inventor: W. Gregory Erf, 74 Cobbs Hill Dr., Rochester, N.Y. 14610

[21] Appl. No.: 261,462

[22] Filed: May 7, 1981

Related U.S. Application Data

[63] Continuation of Ser. No. 164,671, Jun. 30, 1980, abandoned.

[51] Int. Cl.[3] ..... G03C 1/16

[52] U.S. Cl. ..... 430/203; 430/396; 430/236

[58] Field of Search ..... 430/396, 14, 235, 236, 430/351, 202, 203

[56] References Cited

U.S. PATENT DOCUMENTS

| | | | |
|---|---|---|---|
| 3,222,167 | 12/1965 | Van Heerentals | 430/396 |
| 3,692,524 | 9/1972 | Bideau et al. | 430/396 |
| 3,748,981 | 7/1973 | Staes et al. | 430/396 |
| 3,819,373 | 6/1974 | Sable | 430/396 |

*Primary Examiner*—John E. Kittle
*Assistant Examiner*—John L. Goodrow
*Attorney, Agent, or Firm*—Robert B. Watkins

[57] ABSTRACT

A photographic process, and the product therefrom, comprising over-exposing color positive transparency film in a camera while focused upon an object to produce a latent image of the object upon the film and then developing the latent image upon the film by emersion in appropriate film development materials sequentially, with the emersion time in the first developer substantially reduced from normal to produce a low contrast actual image on the film; and thereafter, projecting and exposing the actual image on the transparency film onto an instant print film which is being maintained at a temperature at least as high as normal ambient exposure temperature prescribed for the instant print film; and then developing the instant print film according to the prescribed procedure at a temperature at least as high as normal ambient development temperature prescribed for the instant print film.

17 Claims, 2 Drawing Figures

STEP I

A. OVEREXPOSE COLOR TRANSPARENCY FILM TO PRODUCE LATENT IMAGE

B. DEVELOP THE COLOR TRANSPARENCY FILM WITH SHORTENED TIME IN FIRST DEVELOPER TO PRODUCE ACTUAL IMAGE

STEP II

C. EXPOSE INSTANT COLOR FILM TO ACTUAL COLOR TRANSPARENCY IMAGE TO PRODUCE LATENT IMAGE UPON INSTANT COLOR FILM

D. DEVELOP INSTANT COLOR FILM TO PRODUCE ACTUAL IMAGE PRINT

PHOTOGRAPHIC PROCESS OF PRODUCING PHOTOGRAPHIC PRINTS UPON INSTANT PRINT FILM

SUMMARY OF THE INVENTION

This application is a continuation of a co-pending application by the same inventor, Ser. No. 164,671, filed June 30, 1980 now abandoned.

This invention relates to a process of making photographic pictures and to the product resulting from the process. More particularly it relates to the process of producing good quality photographic prints upon so-called "instant" print film from positive image transparencies.

"Instant" print film is a term commonly used to represent those photographic materials in which a liquid reagent is releasable to permeate a photosensitive layer having formed therein, a latent image; in which the reagent develops the latent image and gives, as a reaction product, an image-forming component; in which the image-forming component is translated relative to the material of the developed latent image to form in another layer of material an image which is positive of the subject matter to which the film was exposed in producing the latent image; in which the positive image-forming component is reacted in its relatively translated position to give a dye or pigment for forming the positive image; in which the transfer image is formed in positive print material separate from the photosensitive layer and in which all the materials involved in the formation of the latent image, and the positive print thereof, are included.

The photographic process of producing color print images is the subject of great variation. Variation in film processing takes place either inadvertently through lack of control of the processing or purposely as the skill and ingenuity of the processors is applied. Photographers and film processors will often vary the process variables to achieve certain, specific results of special kinds of color reproduction, high or low contrasts, colors which are rich or pastel and colors which vary over a large or short tonal scale. However, normally it is the endeavor of the photography to produce the most natural and lifelike color print reproduction of the actual scene as it appeared to the human eye at the time and place that the object was photographed. These normal photographs, which come nearest to be like the actual image as seen by the human eye and the camera at the same time, are considered to be of the highest quality and to be the most sought after by photographers and film processors. Pictures and prints carrying these qualities are sought, with extremely rich color, normal contrast, and normal tonal scale.

In addition to the aspects of color reproduction, the photographer has other known photographic objectives such as clarity. The best quality is produced by sharp focus which relies upon lens quality from the camera equipment, and from resolution of the photographic films which are used in the photographic process. The subjects of obtaining sharply focused images through the use of lenses and the subject of film resolutions are well known and well covered in the literature and understood by those skilled in the photographic arts. Therefore, they need not be dealt with in any depth in this disclosure.

However, in color photography, photographers have found that the best final prints, that is meeting the most desirable qualities as described above, can most easily be made on color transparency films whereon the colors are produced in their positive image relationship as distinguished from color negative films whereon the images are produced in their reversed color form. The terms color positive film and color negative film are well known terms in the art and those skilled in the art will understand these terms as they are used herein.

Consequently, the professional photographer and the serious amateur most often and usually uses color transparency positive image film as the medium for his work and photographic activity.

Color transparency films are developed in many well known processes and the manufacturers prescribe normal processing techniques for the development of these films.

Color transparency films usually have finer grain and therefore are capable of producing images with better resolution and sharper enlargements which is the ultimate medium of the professional photographer and the serious amateur.

Good quality in normally developed color transparencies will provide brilliant pictures when projected on a viewing background. Projection is used quite frequently as the viewing mode by all groups of photographers. In the projected image mode, many important characteristics of these color transparency films are brought out and used to their fullest. For instance, normal characteristics of a transparency is that it will be contrasty and have a normal to short tonal scale. These two features, while desirable, when the films are used in the projection mode of viewing, are very undesirable in the production of print images on photographic printing paper.

In the past, in order to produce good quality prints from color positive transparency images, it has been necessary that a color reversed, intermediate film negative be made from which the final positive print can be made. Many color prints are made using this intermediate two step process because the final print pictures have the potential of having sharper images through better resolution than those which are made by the more common color negative film process. In the color negative film process, the film that is exposed in the camera has a negative image with colors reversed from which the color positive print can be made directly. However, for reasons beyond the scope of this disclosure, color negative films are not capable of strong contrast, brilliant colors, nor of producing as sharp in image because of their resolution.

As stated above, instant films provide a completely integrated process in which the latent image is created, developed and printed from materials which are provided in a package. In the usual practice, the image of the object is focused on the film and the latent image is created by camera exposure. Then in a manipulative process of rollers and/or crushed packages of chemicals, the film is developed insitu and presented in a matter of minutes, fully developed and ready for viewing and use. Because instant film is made to receive a positive image, and transparency film produces a positive image, the two may be used together as a complete photographic process. However, prior to this invention, this combination has not received attention because the high contrast and narrow tonal range of positive transparency film is not suitably matched to the higher contrast and narrower tonal range of instant films which are readily available.

It is an object of this invention to provide a photographic process of making positive color prints on instant color films by exposure from the positive color transparencies in which variables of the process are controlled in new and surprising ways to compensate for the differences in contrast and tonal characteristics in the transparency film and the instant film to produce excellent quality prints, with high resolution and a full range of tonal qualities. It is a further object to provide a process of printing from color transparencies to eliminate the immediate film step previously required for producing prints from the transparencies.

An object of this invention is to make it convenient and possible to photograph using color transparencies with instant print films as a substitute for color print paper, which allows one to make color prints in a very short time. In addition, in this process, there is no need to use messy developing tubes or trays nor to spend time and care with measuring and mixing chemicals in the process. Also, there is no need for running water.

Instant print films and particularly those produced and sold as "Polacolor 2" and "Polacolor ER" by the Polaroid Corporation of Cambridge, Mass., have very good color stability and in most instances, better than that obtained by the normal color printing process when color printing papers are used and developed. Because instant color films are intended primarily for the entire color photographic process, i.e., to receive the latent image, have it developed, and remain the final print, they are apparently manufactured with exceptional quality control and care. Experience has shown that they have a high degree of consistency of color balance from one box of film to the next of the same emulsion number.

For the objects stated above, and to provide the advantages sought over prior photographic processes and to simplify the production of excellent quality photographic prints from color transparencies, this invention comprises the process of over-exposing color positive transparency film in a camera while focused upon an object to produce a latent image of the object upon the film and then developing the latent image upon the film by emersion in appropriate film development materials sequentially, with the emersion time in the first material substantially reduced from normal to produce a low contrast actual image on the film; and thereafter, projecting and exposing the actual image on the transparency film onto an instant print film; and then developing the instant print film according to the prescribed procedure.

A clearer understanding of the invention will be apparent from the following drawing and detailed description.

DETAILED DESCRIPTION OF THE INVENTION

Figures 1, 2:
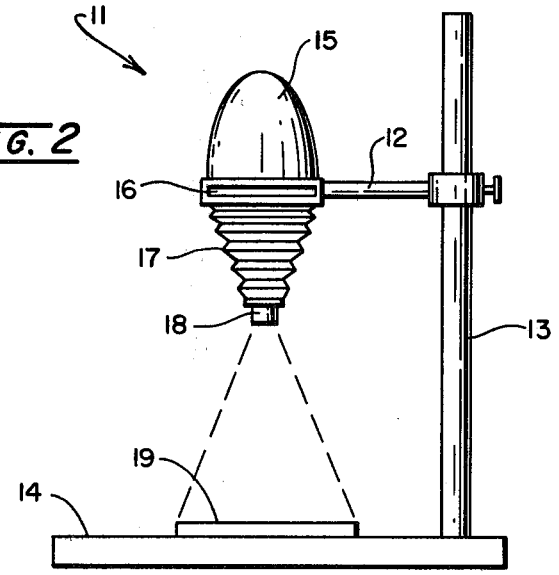
FIG. 1 is a diagram of the process of this invention.
FIG. 2 is an elevational view of a typical enlarger and print making arrangement for a photographic process.

In the process of making photographic prints according to this invention, as shown in FIG. 1, the first step I-A is the exposure of color positive transparency film in a camera which has the usual features and apparatus for control over the exposure process. For the practice of the process, it has been found that the initial exposure of the transparency film must be controlled to produce a transparency having lower contrast and broader tonal scale. This is accomplished by over-exposing the film during the exposure process. One way this can be accomplished is by considering the film as having about one-sixteenth or six percent of its normally prescribed ASA rating. For example, transparency films with slow or medium ASA ratings of perhaps 64–200 should be exposed at about six percent of their normal effective ASA rating. To accomplish this, those cameras which have a provision for setting the ASA rating of the film can be set to show an ASA rating one-sixteenth or six percent of the prescribed rating. This will normally result in the aperture being opened three or four F stops beyond normal for the light available at the time of exposure of the film in the camera. Higher speed transparency films, such as ASA 400, should be exposed at about one-eighth or twelve percent of their normal prescribed effective ASA rating.

In the next step I-B in the process, the film is developed in a process in which the development time than the film spends in the first developer chemical is decreased.

In the usual color transparency film development process, the exposed film is processed by successive sequential immersions in many chemical solutions. The first chemical solution is the first developer which develops the latent image. This developed image determines the contrast, density, tonal range and color of the fully processed color transparency.

Since only the first developer, not the other solutions, can reduce contrast and expand the tonal range; then it is only the length of time in the first developer that need be changed. Decreasing the development time from what is recommended by the manufacturer will produce a color transparency suitable for exposing onto instant print films.

The rest of the process must be carried out as the manufacturer requires. The other chemical solutions are needed to make the image positive, add color and make the image permanent. The subject of color transparency film development is well known and well covered in literature. It is understood by those skilled in the photographic arts. Therefore, it need not be dealt with in any depth in this disclosure.

Referring to CHART X below, a general description is disclosed of the E-6 process developed and marketed by the Eastman Kodak Company of Rochester, N.Y. It should be noted that this invention requires no understanding of the E-6 process, except that the first developer time needs to be decreased.

CHART X

HOW TO PROCESS
KODAK EKTACHROME FILMS
USING PROCESS E-6
GENERAL PROCESSING SPECIFICATIONS

| SOLUTION | TIME (MIN)* | TEMPERATURE OF | FUNCTION OF EACH PROCESSING STEP |
|---|---|---|---|
| First Developer | 6 | 100.4 ± 0.5 | Develops a negative image |
| First Wash | 2 | 92–102 | Acts as a stop bath |
| Reversal Bath | 2 | 92–102 | Reverses the negative image to form a positive image |
| Normal room lights may be used after one minute in reversal bath | | | |
| Color | 6 | 100.4 ± 1.1 | Adds color to image |

CHART X-continued

HOW TO PROCESS
KODAK EKTACHROME FILMS
USING PROCESS E-6
GENERAL PROCESSING SPECIFICATIONS

| SOLUTION | TIME (MIN)* | TEMPERATURE OF | FUNCTION OF EACH PROCESSING STEP |
|---|---|---|---|
| Developer | | | |
| Conditioner | 2 | 92–102 | Prepares film for bleach |
| Bleach | 6 | 92–102 | Converts metallic silver grains into silver halides for removal by fixer |
| Fixer | 4 | 92–102 | Makes image permanent |
| Final Wash | 4 | 92–102 | Removes Fixer |
| Stabilizer | ½ | Ambient | Wetting Agent |
| Dry | | 68–140 | |

*Because of the various types of equipment in which the process E-6 is used, the times will vary slightly.

The E-6 process is by far the most widely used process for developing color transparencies, and it represents the state-of-the-art for both amateur and professional photographers alike. Because of the complexity and need for quality control of photographic film development processes, processing is done mostly by professional photographic laboratories that offer those services most often demanded by the serious amateur and professional photographers.

It should be noted that the E-6 process is not the only process that develops color transparencies. Other processes are available and are very similar, so that methods disclosed in this invention will apply to other processes since all color transparency processes have the same type of first developer.

For slower and medium ASA rated films (64–200), the development time in the first developer is reduced about sixty percent. A slight increase in agitation may be needed to insure even development. Development time in the other development bath and processing remains as normal and as prescribed for the type of film being processed. Films that are developed in the E-4/E-6 color process will give excellent results when processed according to the above. The designations E-4 and E-6 are well known terms of photographic art and will be understood by those skilled therein. These terms refer to processes developed and marketed by the Eastman Kodak Company of Rochester, N.Y.

With high speed transparency film such as ASA 400, the time in the first developer is reduced by fifty percent. Again, with this film, only the time in the first developer is changed and reduced from that prescribed by the manufacturer and all their steps are carried out as the manufacturer recommends.

Accordingly, using the E-6 process the time in the first developer for slower and medium rated films (64–200) is about 2.4 minutes. The time for fast films, 400 ASA and higher, is about 3 minutes.

In the manufacture of photographic materials and equipment the manufacturer cannot define exact usage. Recommended normal usage is based upon averages and the manufacturer can only recommend effective film speeds and developing times. This is because the manufacturer of films cannot control irregularities in individual lens, shutters, light meters, and developers which can and do deviate from considered averages.

It is common knowledge among serious amateur and professional photographers that exact usage is dependent upon conditions at the time and circumstances. It is common practice among photographers to make individual tests with specific films to determine exact usage in specific situations. For example: to determine the exact working ASA of an Ektachrome 64 film, i.e., rated with an effective film speed of 64 by the manufacturer, the photographer is advised to make a series of exposures based on ASA ratings 40, 50, 64, and 80. The rating giving the best result should thereafter be used for that particular film under similar conditions—lens, shutter, light meter, developer and printing process, not to mention the photographer's personal concept of print quality. Once the photographer has completed individual tests, the photographer can predict exact usage with his own equipment and procedures.

This invention is based upon a total re-evaluation of what an exposed and developed color transparency should look like. This new and different color transparency will have the characteristics which will make it ideal for printing onto instant print film. This printing technique differs so radically from given norms, that it becomes a new, separate technique. It should be noted that the data given in this disclosure are effective film speeds, effective developing time and effective developing temperatures, which are based on averages. Exact usage will have to be determined with individual equipment like any other photographic material or process.

In Steps I-A and I-B of the process of this invention, any color transparency film that responds well to overexposure and under-development can be used. Films that are developed in the E-4-E-6 color process will give excellent results. A very good film would be, for instance, Ectachrome 200, with an effective ASA rating of 200. This is manufactured by the Eastman Kodak Company of Rochester, N.Y.

When exposure and development have been carried out according to the process of this invention, the transparencies will be very low in contrast and appear to be slightly less dense and over-exposed in relationship to what is usually considered normal for a transparency. This transparency will have very little shadow density and colors will appear to be flat or pastel looking. It is important that the transparencies have a short range of densities and be low in contrast.

After the transparency film is dried in a conventional process, prints are made on instant print film in accordance with Steps II-C and II-D of the process of this invention. Typical instant print films which have been used in practicing the process of this invention are "Polacolor 2" and "Polacolor ER" which are manufactured by the Polaroid Corporation of Cambridge, Mass.

Because instant print films are characterized by the fact that they are developed insitu, the chemicals involved in the process are a part of the total film package and special equipment is provided in either the camera or the package to release the chemicals after the film has been exposed. The advantages of this invention is that the process uses the important simplicity inherent in the instant film processing system, so that no other processing chemicals containers, or even running water, is involved.

In process Step II-C, making prints from instant film materials is the same as printing on any other direct positive print material, i.e. the exposure and manipulative steps are the same. A commercially available enlarger, having color printing filters, is used. Enlarging times, F-stops, and filtration are achieved by the methods used with the normal, direct positive print materials.

Considering process Steps II, it should be understood that this brings together two established processes that until this invention, have been considered incompatible. The two established processes that are involved are, one, the subject of proper exposure and development of transparency films; and two, the subject of making direct color prints from transparencies.

Making direct color positive prints from color transparencies in the conventional way involves proper exposure of photographic paper from an intermediate negative which will produce a positive image when processed by a sequence of chemical solutions. This is a wet and time consuming process, as are other previous print making processes from transparencies.

This invention replaces the photographic paper in the direct positive printing process with instant print films, which will produce a direct positive print in minutes. The subject of making direct color positive prints from transparencies, in the usual prior art way, is well known and well covered in literature and understood by those skilled in the photographic arts. Therefore, it need not be dealt with in any depth in this disclosure.

Until this invention "instant" print color films have primarily been used and designed for use in a camera to yield a positive print in minutes. This invention eliminates the camera and uses a conventional color enlarger with a positive color transparency, as described in FIG. 1, Steps I.

Proper exposure of the instant print film is important and should be carried out as the manufacturer recommends. Instructions about proper exposure by the manufacturer will always be directed to exposure in a camera and not an enlarger. Since both the camera and enlarger have the same exposure controls (F-stops and duration of time) applying these same instructions to an enlarger will achieve a proper enlarger exposure.

Referring to FIG. 2, photographic print making apparatus is shown, having an enlarger 11, supported by an arm 12, which is slidingly engaged on a stanchion 13 that is connected from a base 14. The enlarger 11 comprises a lamphouse 15, with a high intensity electric lightbulb (not shown), a filter tray 16, negative carrier 20, bellows 17, and a lens 18. An easel or film holder 19, removably rests upon the base 14.

In the process Steps II-C and II-D, a positive transparency that has been exposed and developed in accordance of Steps I-A and I-B of this invention is placed in the negative carrier. The image on the transparency is focused by means of lens 18 upon the instant print film in the easel 19. When the focus is correct and the size of the image has been determined by the adjustment of support arm 12 on stanchion 13, the film is exposed by the lamp in the lamphouse 15.

The type of easel and the manipulative steps of positioning the instant film beneath the enlarger will be different depending on how the instant print film is packaged and made available to the user.

Instant print films of the "Polacolor 2" or "Polacolor ER" variety are designed, packaged and sold for use in film packs or film holders which adapt for use in specific cameras. When this film is used to make prints from transparencies, the film must also be used in its companion film pack or film holder. This is because after exposure, the film must run through its specially provided equipment which contains rollers or other devices that cause the developing materials to be released onto the film.

When using instant print film supplied in a film pack the film is exposed in the film pack. In total darkness, the loaded film pack becomes an easel and after exposure the film pack is inserted into its specially provided equipment for processing, which is generally a camera.

When using "instant" film that has a film holder requirement, it is necessary to place the loaded film holder, with the dark slide in place on the enlarging easel parallel to the transparency. In total darkness, the dark slide is removed, the exposure made, and the dark slide is pushed back in over the film. The film can then be processed as designed by the manufacturer of the film holder.

In carrying out Steps II-C and II-D of the process of this invention the tonal quality of the instant film must be taken into consideration. Unless the instant print film is at a proper temperature to develop the tonal quality and color saturation to a maximum, the print quality of a print made by the process of the invention will not be optimal, very good, or sufficient to meet the objectives of this invention. When using transparencies produced in Steps I-A and I-B, the tonal quality and color saturation obtainable in Steps II-C and II-D with instant print films will be at its optimum degree when the instant print film is maintained at an optimum temperature during exposure and processing. While optimum levels will depend to some degree upon equipment used (lens, camera, film, enlarging equipment) and the specific uses of final prints and the photographers personal concept of print quality, most optimum levels of tonal quality and color saturation have been found between above 90 and 100 degrees F. at the time of exposure and processing from a color positive transparency in an enlarger. However, it has been found that very good final prints can be obtained if the temperature of the instant print film is controlled through a minimum which depends upon the characteristics of the instant print film being used.

It has been found when using "Polarcolor 2" the film should be at a temperature between 90 degrees F. and 120 degrees F. On the other hand, when using "Polarcolor ER" film it has been discovered that the film should be maintained at a temperature of between about 75 degrees F. and 120 degrees F.

From the practice of this invention, it has been determined that, generically speaking, the temperature must be maintained at least above a minimum threshold for the particular instant print film in use, such that the tonal range will produce at or near maximum color saturation for that film. In practice, it has been found that when practicing Step II of this invention using "Polarcolor ER" film, Step II can be carried out with film that is at ambient room temperature, i.e. about 70–75 degrees F., and very good results can be obtained. On the other hand, when practicing Steps II of this invention with "Polarcolor 2" film, it is better to maintain the film at an elevated temperature of between about 90 degrees F. and 120 degrees F. Notwithstanding the differences discussed above with respect to the various instant print films, it has been found that optimum results are obtained when the instant print film is maintained at an elevated temperature of between about 90 and 100 degrees F. at the time the exposure is made from the transparency in the enlarger.

In order that this temperature be uniform, it has been found desirable to maintain the film, its packaging materials, film holders, and other associated materials to the desired temperature for a period of as long as 1–2 hours before use. These temperature control procedures, while not a part of the process, are helpful in assuring that the film is exposed at the desired temperature as near as conveniently possible.

After the exposure is made in Step II-C, the instant print film is developed in Step II-D in accordance with the prescribed procedures that are made available with the particular film in use. If the film that is being used is part of a film pack, after exposure the film pack is reinserted into its specially provided equipment where the required steps are carried out that actuate and release the developer materials upon the film. For instance, in processing the "Polarcolor" film pack material, the edges of the film have tabs which are used to draw the films through rollers which crush pods or capsules of development materials and spread them across the film to develop the print. The mechanical steps and the chemistry of development of instant print films is not a part of this invention. Complete understanding is either not required to practice this invention or is sufficiently described by the manufacturers of these films that this invention can be practiced by those skilled or even only semi-skilled in photographic technology.

In the practice of Step II-D, the development of the instant print film should take place at or about the same temperature at which the film is exposed in Step II-C. The temperature of the development will normally be correct and sufficiently controlled if the film is at the correct temperature at the time of exposure in Step II-C, and if the development process is carried out immediately following the exposure step described above.

As stated for the exposure Step II-C, it has been found that developing temperatures of between about 90 and 100 degrees F. are ideal, although good color saturation with minimum contrast increase can also be obtained when the development temperatures are maintained between 90–120 degrees F. when using "Polarcolor 2" film and the development time is kept at about 60 seconds. When using "Polarcolor 2" film, temperatures dropping below 90 degrees F. do not produce the saturated colors most often looked for in a photographic print. However, when using "Polarcolor ER" film, the minimum development temperature for very good results can be as low as the 70–75 degree range. It should be generally understood that the temperature range, and the actual operating temperature, used in the development Step II-D should generally match the temperature being practiced in the previous Step II-C.

Extending the processing time past 60 seconds will produce an unwanted increase in the contrast of the final print. When familiarity of these effects of temperature and time become apparent, they can be utilized creatively to achieve specific ends. As will be further born out by the examples listed below, when all of the steps of the process of this invention are carried out properly, the final print will show greater color saturation than the transparency, making an excellent color print comparable to any other printing process.

EXAMPLE ONE

An Ektachrome 200 color positive transparency film (manufactured to Eastman Kodak Company of Rochester, N.Y.) having an ASA rating of 200 was focused on a man (head and shoulders portrait) in daylight. A picture was exposed on the film at F-8 at a 30th of a second. This was equivalent to an ASA rating of 12 for normal exposure.

The transparency film was developed in a conventional E-6 process except that the film was emersed in the first developer solution about 2½ minutes which is about 60% less than normal. A low contrast flat, pastel actual image appeared on the film which was processed and fixed in the usual procedure and solutions.

After drying, the transparency film was exposed to a "Polarcolor 2" (manufactured by Polaroid Corporation of Cambridge, Mass.) instant print film with a conventional color enlarger. The instant film had been preheated for about one hour to a temperature of about 100 degrees F. The film was exposed for 4 seconds.

After exposure the instant print film was developed by passing it through the rollers provided for its film package and allowing the positive and negative sheets to remain in contact for about 60 seconds. At the end of 60 seconds, the sheets were separated.

The resulting final print was of greater color saturation than the transparency and an excellent color print comparable in quality to that from any other color process.

EXAMPLE TWO

A photographic print was made as described in Example One except that the instant print film was exposed and developed at a temperature of about 90 degrees F. The resulting final print was very good.

EXAMPLE THREE

A photographic print was made as described in Example One except that the instant print film was exposed and developed at a temperature of about 120 degrees F. The resulting final print was very good.

EXAMPLE FOUR

A photographic print was made as described in Example One except that the instant print film was exposed and developed at a temperature of about 75 degrees F. The resulting final print was not good quality because the color saturation was not as great.

EXAMPLE FIVE

An Ektachrome 200 color positive transparency film (manufactured by Eastman Kodak Company of Rochester, N.Y.) having an ASA rating of 200 was focused on a man (head and shoulders portrait) in daylight. A picture was exposed on the film at F-8 at a 30th of a second. This was equivalent to an ASA rating of 12 for normal exposure.

The transparency film was developed in a conventional E-6 process except that the film was emersed in the first developer solution about 2½ minutes which is about 60% less than normal. A low contrast flat, pastel actual image appeared on the film which was processed and fixed in the usual procedure and solutions.

After drying, the transparency film was exposed to a "Polarcolor ER" (manufactured by Polaroid Corporation of Cambridge, Mass.) instant print film with a conventional color enlarger. The instant film had been allowed to reach ambient room temperature of about 72 degrees for about 1 hour. The film was exposed for 4 seconds.

After exposure, the instant print film was developed by passing it through the rollers provided with its film package and allowing the positive and negative sheets to remain in contact for about 60 seconds. At the end of 60 seconds the sheets were separated.

The resulting final print was of greater color saturation than the transparency and a very good color print generally comparable in quality to that of any other process.

EXAMPLE SIX

A photographic print was made as described in Example Five except that the instant print film was exposed and developed at a temperature of about 90 degrees F. The resulting final print was very good.

EXAMPLE SEVEN

A photographic print was made as described in Example Five except that the instant print was exposed at a temperature of 120 degrees F. The resulting final print was very good.

EXAMPLE EIGHT

A photographic print was made as described in Example Five except that the instant print film was exposed and developed at a temperature of about 65 degrees F. The resulting print was not good quality because the color saturation was not as great.

EXAMPLE NINE

A high speed Ektachrome 400 color positive transparency film (manufactured by Eastman Kodak Company of Rochester, N.Y.) having an effective ASA rating of 400 was exposed in a camera while focused on a man (head and shoulders portrait) in daylight. A picture was exposed on the film at F-8 at 125th. This was equivalent to an effective ASA rating of 50 for normally prescribed exposure.

The transparency film was developed in a conventional E-6 process except that the film was emersed in the first developer solution about 3 minutes which is 50% of normal. A low contrast flat, pastel actual image appeared on the film which was processed and fixed in the usual procedure and solution.

After drying, the transparency film was exposed to a "Polarcolor 2" (manufactured by Polaroid Corporation of Cambridge, Mass.) instant print film in a conventional enlarger. The instant film had been preheated for about one hour to a temperature of about 100 degrees F. The film was exposed for 4 seconds.

After exposure, the instant print film was developed by passing it through the rollers provided with its film package and allowing the positive and negative sheets to remain in contact for about 60 seconds. At the end of 60 seconds, the print was separated.

The resulting final print was of greater color saturation than the transparency and an excellent color print comparable in quality to that from any other color process.

EXAMPLE TEN

A high speed Ektachrome 400 color positive transparency film was exposed and developed as described in Example Nine.

After drying, the transparency film was exposed to a "Polarcolor ER" instant print film in a conventional enlarger. The instant film had been maintained for about 1 hour at a temperature of about 75 degrees F. The film was exposed for 4 seconds.

After exposure, the instant film was developed by passing it through rollers provided with its film package and allowing the positive and negative sheets to remain in contact for about 60 seconds. At the end of 60 seconds, the print was separated.

The resulting print was of greater color saturation than the transparency, and a very good final print.

The CHART Y below shows the relationship of the various exposure parameters between the prior art normal effective usage and the practice of this invention.

CHART Y

| ASSUME NO CHANGE IN SHUTTER SPEED | | | | | |
|---|---|---|---|---|---|
| NORMAL EFFECTIVE ASA | NORMAL F STOP | INVENTION PROCESS ASA | INVENTION PROCESS F-STOP | CHANGE % OF NORMAL ASA | CHANGE % OF NORMAL AMT. OF LIGHT |
| 50 | 8 | 3 | 2 | 6% | 800% |
| 100 | 11 | 6 | 2.8 | 6% | 800% |
| 200 | 16 | 12 | 4 | 6% | 800% |
| 400 | 22 | 50 | 8 | 12% | 400% |

When dealing with ASA, fractions, percentages, and amount of actual light, it is difficult to relate these to each other over a span of more than a few numbers. Example: the relationship of ASA 12 to ASA 200 is that ASA 12 is 6% of 200. Therefore, ASA 200 requires 1/16 less light than ASA 12 or ASA 12 requires 800% more light than ASA 200.

Cameras, light meters, shutter speeds, F-stops, and ASA are all based on a "halving or doubling sequence." The CHART Z below will show the intermediate stops between considered normal and invention process. This will help to clarify invention process percentages and ASA.

CHART Z

| ASSUME NO CHANGE IN SHUTTER SPEED | | | | | |
|---|---|---|---|---|---|
| | UNITS OF LIGHT | | | | |
| | 1 EFFECTIVE NORMAL | 2 | 4 INTERMEDIATE STOPS | 8 | 16 INVENTION PROCESS |
| ASA | 50 | 25 | 12 | 6 | 3 |
| % OF NORMAL ASA | 100% | 50% | 25% | 12½% | 6¼% |
| FRACTION OF NORMAL ASA | 1/1 | ½ | ¼ | ⅛ | 1/16 |
| F-STOP | 8 | 5.6 | 4 | 2.8 | 2 |
| % INCREASE IN AMOUNT OF LIGHT | 0% | 100% | 200% | 400% | 800% |
| NUMBER OF STOPS INCREASE IN EXPOSURE | 0 | 1 | 2 | 3 | 4 |

CHART Z-continued

| ASSUME NO CHANGE IN SHUTTER SPEED | | | | | |
|---|---|---|---|---|---|
| | UNITS OF LIGHT | | | | |
| | 1 EFFECTIVE NORMAL | 2 | 4 INTERMEDIATE STOPS | 8 | 16 INVENTION PROCESS |
| ASA | 100 | 50 | 25 | 12 | 6 |
| % OF NORMAL ASA | 100% | 50% | 25% | 12½% | 6¼% |
| FRACTION OF NORMAL ASA | 1/1 | ½ | ¼ | ⅛ | 1/16 |
| F-STOP | 11 | 8 | 5.6 | 4 | 2.8 |
| % INCREASE IN AMOUNT OF LIGHT | 0% | 100% | 200% | 400% | 800% |
| NUMBER OF STOPS INCREASE IN EXPOSURE | 0 | 1 | 2 | 3 | 4 |
| ASA | 200 | 100 | 50 | 25 | 12 |
| % OF NORMAL ASA | 100% | 50% | 25% | 12½% | 6¼% |
| FRACTION OF NORMAL ASA | 1/1 | ½ | ¼ | ⅛ | 1/16 |
| F-STOP | 16 | 11 | 8 | 5.6 | 4 |
| % INCREASE IN AMOUNT OF LIGHT | 0% | 100% | 200% | 400% | 800% |
| NUMBER OF STOPS INCREASE IN EXPOSURE | 0 | 1 | 2 | 3 | 4 |
| ASA | 400 | 200 | 100 | 50 | |
| % OF NORMAL ASA | 100% | 50% | 25% | 12½% | |
| FRACTION OF NORMAL ASA | 1/1 | ½ | ¼ | ⅛ | |
| F-STOP | 22 | 16 | 11 | 8 | |
| % INCREASE IN AMOUNT OF LIGHT | 0% | 100% | 200% | 400% | |
| NUMBER OF STOPS INCREASE IN EXPOSURE | 0 | 1 | 2 | 3 | |

Instant print films are capable of some development temperature latitude with variation in development time. For instance, the normal recommended development time is 60 seconds at the preferred development temperature of about 75 degrees F. However, if the development time is extended up to 90 seconds, development of good color saturation can be obtained at lower development temperatures such as 65 degrees or 55 degrees F. However, it has been found that extending the development time increases the contrast and this is undesirable in the achievement of excellent quality or very good quality final prints.

It should be understood that with the generally increasing availability, and probably continued availability of instant print film such as "Polarcolor ER", the most significant manipulative steps in the practice of this invention are those in Step I-A and Step I-B. In practice, when using a film such as "Polarcolor ER", Step II-C and Step II-D become simply precautions that the temperature of the instant print film does not fall below normal ambient operating temperatures by some untoward event.

Throughout this disclosure and the examples, general well used terms describing the practice of photography have been used without detailed physical/scientific/-technological background definition. It is intended that the terms have the usual ordinary meaning that those skilled in photographic activity at the level of the use of this invention except and understand. This is an invention of primary interest and significance to the professional and serious amateur photographer as well as those interested in film processing at the commercial level. At these levels, the detailed scientific technological understanding of the chemical and physics processes by which the invention achieves the results obtained are not necessary.

Typical examples of prior art patents that are related to the subject of this invention are U.S. Pat. Nos. 2,543,181, 3,222,167 and 3,692,524. These are listed in recognition of the duty of disclosure of related subject matter, which may be relevant, under 37 CFR 1.56.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

What is claimed is:

1. A process for making photographic color prints from a color positive transparency film of an object comprising, sequentially:

a. over-exposing the color positive transparency film in a camera while focused upon the object to produce a latent image upon the film;

b. developing the latent image upon the film, by immersion in developing materials sequentially, with immersion time in the first developer material reduced from effective normal to produce a low constrast actual image on the film;

c. projecting and exposing the actual image which is on the transparency film onto an instant print film according to the prescribed normal effective exposure procedures, times and temperatures; and d. developing the instant print film according to the normal prescribed procedure.

2. A process, according to claim 1, wherein the color positive transparency film is over-exposed, according to (a) about three to four F-stops.

3. A process according to claim 1, wherein the immersion time in the first development material, according to (b), is reduced about 60% to 50% from the normal effective time.

4. A process according to claim 1, wherein the temperature at which the instant print film is exposed in (c) is a temperature between about 70 degrees F. and about 120 degrees F.

5. A process according to claim 1, wherein instant print film is exposed in (c) at a temperature of between about 90 and 100 degrees F.

6. A process according to claim 4, wherein the instant print film is developed in (d) at a temperature of between about 70 degrees F. and about 120 degrees F.

7. A process according to claim 5, wherein the instant print film is developed in (d) at an elevated temperature of between about 90 and 100 degrees F.

8. A process according to claim 1, wherein the color transparency film has a normal effective ASA rating of between about 64 and 200 and the film is exposed at an ASA rating of about 6% of its normal effective ASA rating.

9. A process according to claim 1, wherein the color positive transparency film has a normal effective ASA rating of about 400 or higher and is exposed at an ASA rating of about 12% of its normal effective ASA rating.

10. A process according to claim 1, wherein color transparency film has an effective ASA rating of about 64 to 200 and the development time in the first developer is reduced about 60% from the normal effective time.

11. A process according to claim 1, wherein the color positive transparency film has a normal effective ASA rating of about 400 or higher and the time of immersion in the first developer material is reduced about 50% from the normal effective time.

12. A process according to claim 1, wherein the color positive transparency film has a normal effective ASA rating of between about 64 and about 200 and is exposed at about 6% of its normal ASA rating and the development time in the first developer is reduced about 60% from the normal effective time.

13. A process according to claim 1, wherein the color positive transparency film has a normal effective ASA rating of 400 or higher and is over-exposed at an ASA rating of about 12% of normal ASA rating and the development time in the first developer is reduced 50% from the normal effective time.

14. A process according to claim 1, wherein the color positive transparency film has a normal effective ASA rating of between 200 and 400 and is exposed at between about 6% and 12% of its normal, effective ASA rating and the development time in the first developer is reduced between about 60% and 50% of the normal effective prescribed time and the instant print film is exposed and developed at between about 70 degrees F. and about 120 degrees F.

15. A process according to claim 14 wherein the instant print film is developed for about 60 seconds.

16. A process according to claim 1, wherein the instant print film is of a type that requires exposure at an elevated temperature to develop the optimum tonal quality and color separation, and the temperature at which the instant print film is exposed in (c) is a temperature between about 90 degrees F. and about 120 degrees F.

17. A process according to claim 1, wherein the instant print film is of a type that requires development at an elevated temperature in the development process to develop the maximum and optimum tonal quality and color saturation, and the print film is developed in (d) at a temperature of between about 90 degrees F. to about 120 degrees F.

* * * * *